United States Patent [19]

Yeung

[11] Patent Number: 4,633,648

[45] Date of Patent: Jan. 6, 1987

[54] CONTAINER CLOSURE SEAL AND METHOD OF MAKING

[75] Inventor: Wing W. Yeung, Roseville, Minn.

[73] Assignee: Minnesota Mining and Manufacturing Company, Saint Paul, Minn.

[21] Appl. No.: 730,489

[22] Filed: May 6, 1985

[51] Int. Cl.[4] ..... B65B 61/18

[52] U.S. Cl. ..... 53/412; 53/419; 53/442; 215/246

[58] Field of Search ..... 215/246, 275, 305, 251; 53/412, 419, 420, 133, 139.3, 557, 442

[56] References Cited

U.S. PATENT DOCUMENTS

| | | | |
|---|---|---|---|
| 2,790,286 | 4/1957 | Snyder | 53/41 |
| 3,146,284 | 8/1964 | Markwood, Jr. | 264/210 |
| 3,491,419 | 1/1970 | Satterwhite | 28/72 |
| 3,640,417 | 2/1972 | Sakurai | 215/246 |
| 3,732,122 | 5/1973 | Christensen | 117/122 |
| 3,739,053 | 6/1973 | Yazawa | 264/154 |
| 3,741,422 | 6/1973 | Wold et al. | 215/305 X |
| 4,000,824 | 1/1977 | Han | 215/232 |
| 4,014,734 | 3/1977 | Patterson | 156/459 |
| 4,134,957 | 1/1979 | Yoshimura et al. | 264/288 |
| 4,177,905 | 12/1979 | Winchell et al. | 215/246 |
| 4,237,088 | 12/1980 | Yoshimura et al. | 264/235 |

FOREIGN PATENT DOCUMENTS

| | | |
|---|---|---|
| 0026911A1 | 4/1981 | European Pat. Off. . |
| 1937222 | 6/1970 | Fed. Rep. of Germany . |

*Primary Examiner*—James F. Coan

*Attorney, Agent, or Firm*—Donald M. Sell; James A. Smith; William L. Huebsch

[57] ABSTRACT

A thin film adapted for forming seals about a closure attached to a container, which film is of uniaxially oriented polyolefin, will easily tear in a straight line in the oriented direction without the need of a tear strip, can be heat shrunk in the range of three to twenty percent in the oriented direction by exposure of about ten seconds to a temperature of about 225° F., and is formed by uniaxially orienting polyolefin at a temperature in the range of 120° to 170° C. by stretching the polypropylene without restraining its edges at a draw ratio in the range of 3/1 to 10/1 and then quickly cooled to prevent substantial heat annealing.

6 Claims, 7 Drawing Figures

CONTAINER CLOSURE SEAL AND METHOD OF MAKING

TECHNICAL FIELD

This invention relates to polymeric film adapted to be heat shrunk around a reusable closure for a container to provide a seal.

BACKGROUND ART

Many heat shrinkable polymeric films are known which can be heat shrunk around a reusable closure attached to an outlet portion of a container to provide a seal that assures a subsequent user that the contents of the container have not been tampered with. U.S. Pat. Nos. 2,790,286, 4,014,734, and 4,000,824 show known examples. While such seals can be effective, the materials described for use as such seals are either not easily torn along a predetermined straight line, require inclusion of a tear strip or need to be perforated to produce a straight line tear, are not sufficiently heat shrinkable to closely conform to the outer contours of a closure and container, and/or are relatively expensive for use as seals.

Known uniaxially oriented polyolefin film materials are generally not suitable for such seals because they are either inadequately processed to provide sufficient heat shrinkability and controlled tearing, or are oriented to such an extent that the film material fibrillates (e.g., U.S. Pat. Nos. 3,491,419 and 3,739,053).

DISCLOSURE OF INVENTION

The present invention provides an inexpensive adequately heat shrinkable film adapted to be used as a tamper resistant seal about a closure (e.g. cap, lid or cork) and an outlet portion of a container (e.g. bottle neck or tub rim), which seal can be easily partially peeled away along a straight line without the use of a tear strip to afford access to the closure and opening of the container.

The film according to the present invention for forming such a seal is a uniaxially oriented polyolefin (which can be a blend of or copolymer of polypropylene and polyethylene) that will tear in a straight line in the oriented direction, will break when stretched to less than about 50 percent of its original dimension in the oriented direction and will break when stretched to less than about 10 percent of its original dimension in a direction disposed at 90 degrees to the oriented direction, and can be heat shrunk in the range of three to twenty percent in the oriented direction by exposure of about ten seconds to a temperature of about 108° C. (225° F.).

Such a film can be formed by a method comprising the steps of uniaxially orienting polyolefin material at a temperature in the range of 120° to 170° C. (250° to 340° F.) by stretching the material without restraining its edges at a draw ratio in the range of 3/1 to 10/1 to form a film having a thickness in the range of 0.0025 to 0.009 centimeter, (0.001 to 0.0035 inch) and then cooling the oriented film to prevent substantial heat annealing and provide a heat shrinkable film. A strip of the oriented film can then be fastened about the closure and the outlet portion of the container with the oriented direction of the strip extending circumferentially around the closure and outlet portion, and the fastened strip of film can be exposed to heat to shrink the strip about the closure and outlet portion of the container to form a seal.

A strip-like portion of the seal thus formed can be easily manually peeled away to allow the container to be opened. That strip-like portion, however, cannot be replaced so that any partial or total removal of that strip-like portion can be easily detected, thereby providing a user of the container with a warning of any previous opening of the container that might have involved tampering with the container contents.

BRIEF DESCRIPTION OF DRAWING

The present invention will be further described with reference to the accompanying drawing wherein like numbers refer to like parts in the several views, and wherein.

DETAILED DESCRIPTION OF ILLUSTRATED EMBODIMENTS

Figure 1:
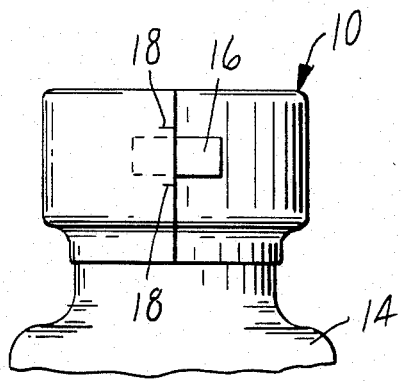
FIG. 1 is a vertical view of a first embodiment of a seal made from film material according to the present invention shown heat shrunk about a closure and an outlet portion of a container closed by the closure.
Figure 2:
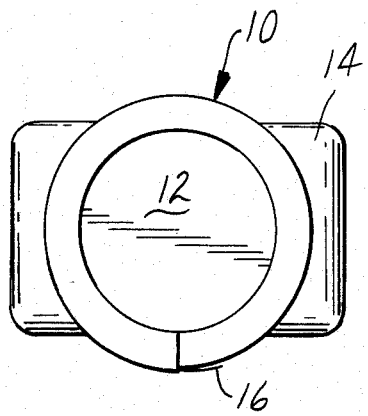
FIG. 2 is a top view of the seal closure and container portion of FIG. 1.
Figure 3:
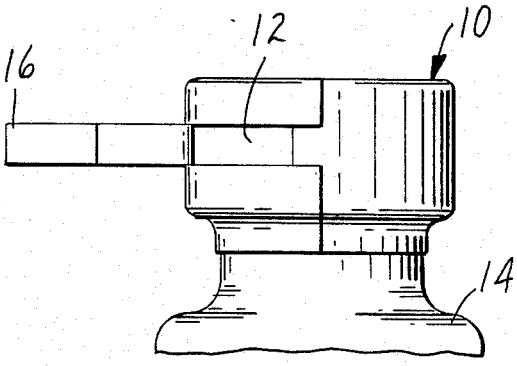
FIG. 3 is a vertical view showing the seal of FIG. 1 being opened.

Referring now to the drawing, there is shown in FIGS. 1, 2 and 3 a first embodiment of a seal made from film material according to the present invention, which seal is generally designated by the reference numeral 10.

The seal 10 comprises a length of the polymeric film heat shrunk about a closure or cap 12 and an outlet portion of a container or bottle 14 with which the cap 12 is threadably engaged to close the bottle 14. The seal 10 must be at least partially peeled away as by peeling away a central strip-like portion thereof (FIG. 3) to allow the cap 12 to be rotated so that the container may be opened. Tearing away such a generally central strip-like portion of the seal preferably is faciliated by a tab 16 of a suitable material (e.g., a stiff paper) and substantially more narrow than the seal 10. The tab 16 is adhered along a short (e.g., 1 cm long) portion of the inner surface of the length of film, with a sufficient length of the tab 16 projecting from the edge of the outer overlapping portion of the length of film so that the tab 16 can be manually grasped and pulled on to open the seal 10. The central portion of the seal 10 thus peeled away will have generally the same width as the tab 16 (e.g., 1 cm), since tearing of the seal 10 will initiate tearing of the seal 10 along the longitudinal edges of the tab 16, and the seal 10 will then tear in straight lines in its longitudinal direction extending around the cap 12 and bottle 14. Two nicks or cuts 18 can be made along the edge of the overlapping portion of the length of film from which the tab 16 projects, which nicks 18 facilitate the initial tearing of the film by use of the tab 16. The nicks 18 are optional, however, as tearing of the film can be easily initiated without them.

Figure 4:
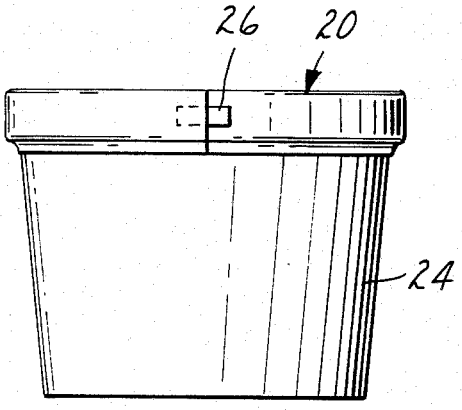
FIG. 4 shows a second embodiment of a seal made from film material according to the present invention shown heat shrunk about a closure and an outlet portion of a container closed by the closure.

Referring now to FIG. 4 of the drawing there is shown a second embodiment of a seal made from film material according to the present invention, which seal is generally designated by the reference numeral 20.

Like the seal 10, the seal 20 comprises a length of the polymeric film heat shrunk about a closure or lid 22 and an outlet portion of a container or tub 24 with which the lid 22 is frictionally engaged to close the tub 24. Also, the seal 20 includes a tab 26 shaped, positioned and attached in a manner similar to the tab 16, which tab 26 is adapted to be manually grasped and pulled to initiate peeling away a central portion of the seal 20. A central portion of the seal 20 can thus be peeled away so that the tub 24 may be opened by prying the lid 22 away from the tub 24.

The film used to form both of the seals 10 and 20 is preferably of a uniaxially oriented polyolefin such as polypropylene or a polypropylene/polyethylene blend that will tear in a straight line in the direction of the orientation without the need for a tear strip, and can be shrunk in the range of three to twenty percent in the oriented direction by exposure of about ten seconds to air at a temperature of about 225° F., (i.e., this is a test of the heat shrinkability of the film, which is preformed in accordance with ASTM Test D 2732-70 except that hot air rather than liquid is used to shrink the material and is not the conditions under which the film is applied to a container which are typically provided by a commercially available air heating tunnel set to heat air within the tunnel to about 200° to 260° C. (400° to 500° F.)).

Figure 5:
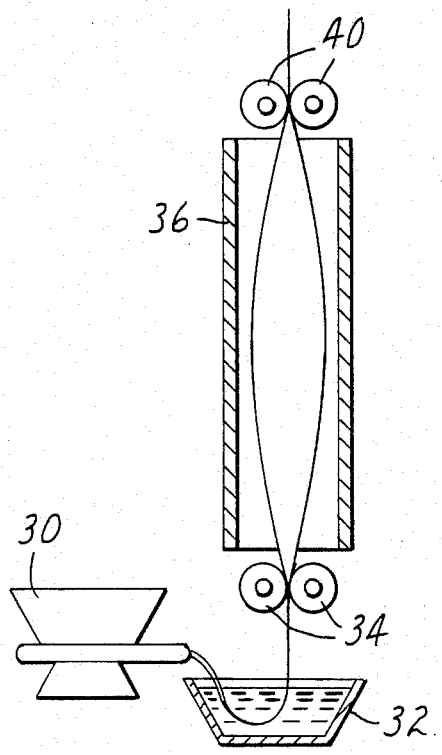
FIG. 5 is a schematic view of a first method for making the film used in the seals of FIGS. 1 and 4.

FIG. 5 illustrates a preferred first method for making film according to the present invention in which polyolefin resin is fed into the feed hopper of a single screw extruder 30 having an extruder barrel temperature adjusted to produce a stable homogeneous melt. The melt is extruded into a tube through a circular die, quenched in a water bath 32, and fed between a first pair of nip rollers 34 driven at a first predetermined speed (e.g., 1.5 meters (5 feet) per minute surface speed). The collapsed polyolefin tube emerging from the nip rollers 34 extends in a vertical path about 5 feet through a cylindrical heating tower 36 which heats air within the tower 36 to about 150° to 170° C., and then between a second pair of nip rollers 40 driven at a second predetermined speed (e.g., 7.6 to 15.2 meters (25 to 50 feet) per minute). Air is initially introduced in the tube between the two pair of nip rollers 34 and 40 and then remains trapped therein to cause the tube to remain cylindrical until it is collapsed by the nip rollers 40. The difference in surface speed between the first and second pair of nip rollers 34 and 40 produces a draw ratio for the cylindrical tube therebetween in the range of about 3/1 to 10/1. Infrared heating in the tower heats the cylindrical tube sufficiently that it stretches to form film that was uniaxially oriented in the longitudinal or machine direction between the two pair of nip rollers 34 and 40 due to their differential speeds, and the oriented film is quickly air cooled to prevent substantial heat annealing and thereby cause the film to be heat shrinkable.

Strips of two different films formed by this process using the parameters specified in the following table were slit, cut to length, and fastened by various means (e.g., adhesive, heat sealing or sonic welding) about closures and container outlet portions of the types shown in FIGS. 1 through 4 with the longitudinally oriented direction of the strip extending circumferentially around the closure and outlet portion. The fastened strips of film were then exposed to heat (e.g., heated air at about 200° to 260° C. in a heat tunnel) and shrank about the closures and container outlet portions to form tight seals that closely conformed to the peripheries of the closure and container portions. The seals thus formed were subsequently easily removed by tearing away central portions of the seals circumferentially around the closures. The seals were found to tear along extremely straight lines, and to produce aesthetically pleasing edges on the remaining portions of the seals.

Tests performed to determine the heat shrinkability of the film showed that the film would shrink in the range of about three to twenty percent in the oriented direction upon exposure for about ten seconds to temperatures of about 225° F.

Figure 6:
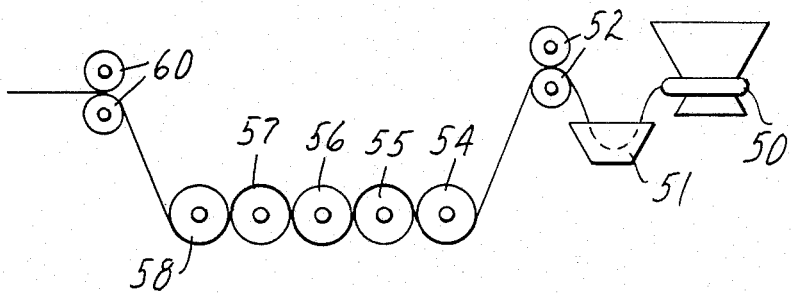
FIG. 6 is a schematic view of a second method for making the film used in the seals of FIGS. 1 and 4.

FIG. 6 illustrates a alternate second method for making film according to the present invention in which polyolefin resin is fed into the feed hopper of a single screw extruder 50 having an extruder barrel temperature adjusted to produce a stable homogeneous melt. The melt is extruded through a flat die to form a sheet. The sheet is quenched in a water bath 51 and fed between a first pair of nip rollers 52 driven at a first predetermined speed (e.g., 1.5 meters (5 feet) per minute surface speed). The sheet emerging from the nip rollers 52 is fed in a serpentine path around 5 parallel aligned adjacent rollers 54, 55, 56, 57 and 58, and then between a second pair of nip rollers 60 driven at a second predetermined speed (e.g., 7.6 to 15.2 meters (25 to 50 feet) per minute) so that the difference in surface speed between the first and second pair of nip rollers 52 and 60 produces a draw ratio in the range of about 3/1 to 10/1. The first four aligned parallel rollers 54, 55, 56 and 57 are internally heated to provide temperatures on their surfaces in the range of about 150° to 170° C. (300° to 370° F.), which surface temperature heats the sheet sufficiently that it begins to stretch to form film that is uniaxially oriented in the longitudinal or machine direction between the third and fourth adjacent parallel rollers 56 and 57 due to the differential speeds of the two pairs of nip rollers 52 and 60. The fifth roller 58 is internally cooled to provide a surface temperature of about 20° C., which quickly cools the oriented film to prevent substantial heat annealing and thereby cause the film to be heat shrinkable.

Strips of two different films formed by this process using the parameters specified in the following table were slit longitudinally, cut to length, and fastened by various means (e.g., adhesive, heat sealing or sonic welding) about closures and container outlet portions of the types shown in FIGS. 1 through 4 with the longitudinally oriented direction of the strip extending circumferentially around the closure and outlet portion. The fastened strips of film were then exposed to heat (e.g., such as heated air at about 200° to 260° C. in a heat tunnel) and shrank about the closures and container outlet portions to form tight seals that closely conformed to the peripheries of the closure and container portions. The seals thus formed were subsequently easily removed by tearing away central portions of the seals circumferentially around the closures. The seals were found to tear along an extremely straight lines, and to produce aesthetically pleasing edges on the remaining portions of the seals.

Tests performed to determine the heat shrinkability of the film showed that the film would shrink in the range of about three to twenty percent in the oriented direction upon exposure for about ten seconds to temperatures of about 225° F.

Figure 7:
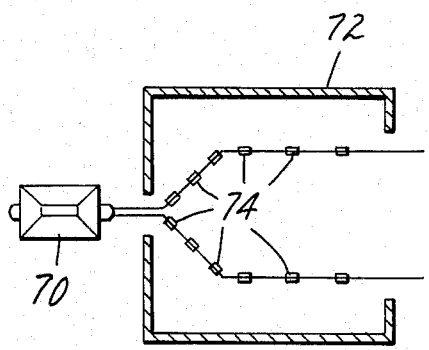
FIG. 7 is a schematic view of a third method for making the film used in the seals of FIGS. 1 and 4.

FIG. 7 illustrates an alternate third method that is useful for making film according to the present invention in which polyolefin resin is fed into the feed hopper of a single screw extruder 70 having an extruder barrel temperature adjusted to produce a stable homogeneous melt. The melt is extruded through a flat die to form a sheet. The sheet is engaged along its opposite edges by grippers 74 and carried into a tenter oven 72 heated to about 150° to 170° C. The grippers 74 are moved along diverging paths in the oven 72 that stretch the film and uniaxially orient it in its transverse direction in the range of about 3/1 to 10/1. The oriented film is then quickly cooled as it leaves the oven 72 to prevent substantial heat annealing and thereby allow the film to be heat shrunk.

Strips of films formed by this process could then be fastened by various means (e.g., adhesive, heat sealing or sonic welding) about closures and container outlet portions of the types shown in FIGS. 1 through 4 with the oriented direction of the strip extending circumferentially around the closure and outlet portion. The fastened strips of film could then be exposed to heat (e.g., such as heated air at about 200° to 260° C. in a heat tunnel) and shrank about the closures and container outlet portions to form tight seals that closely conformed to the peripheries of the closure and container portions.

One particular method of forming seals from film formed by this method would be to form a tube of a desired diameter from a width of the film with the transverse orientation of the film extending circumferentially around the tube, cutting predetermined lengths from the tube, positioning the lengths of tube around the closures and outlet portions of containers, and heat shrinking the lengths of tube in place. This application method appears particularly well suited for use by highly automated application systems.

The following table sets forth the physical characteristics of the film produced by the methods described above together with the method parameters used to form those films.

Properties of Films Made by Methods Illustrated in FIGS. 5 and 6

| Material | Process | Longitudinal Stretch Ratio | Film Thickness (mm) | Shrinkage When exposed to (225° F.) 107° C. for 10 sec (%) | *Tensile strength in longitudinal direction (kg./cm$^2$) | *Elong. before break in longitudinal direction (%) | *Tensile strength in transverse direction (kg./cm$^2$) | *Elong. before break in transverse direction (%) |
|---|---|---|---|---|---|---|---|---|
| 100% Polypropylene | FIG. 5 | 4-1 | 0.051 | 5.4 | 2369 | 46 | 218 | 3 |
| 85% Polypropylene 15% Polyethylene | FIG. 5 | 4-1 | 0.051 | 15 | 1554 | 25 | 162 | 3 |
| 100% Polypropylene | FIG. 6 | 5-1 | 0.061 | 10 | 2226 | 13 | 117 | 0.9 |
| 85% Polypropylene 15% Polyethylene | FIG. 6 | 5-1 | 0.051 | 15 | 1758 | 14 | 176 | 2.6 |

*ASTM 443

While preferred examples of the film according to the present invention have been made by the methods described above, other methods that can uniaxially orient film in either the longitudinal or the transverse direction can also be adopted to make such film.

I claim:

1. In a seal of the type comprising a length of polymeric film heat shrunk about a closure and an outlet portion of a container closed by the closure, which seal must be at least partially peeled away to afford access to the closure and opening of the container, the improvement wherein:

said film is a uniaxially oriented polyolefin film in the range of about 0.0025 to 0.009 centimeter thick that will tear in a straight line in the oriented direction without the inclusion of a tear strip, will break when stretched to less than 50 percent of its original dimension in the oriented direction and will break when stretched to less than about 10 percent of its original dimension in a direction disposed at 90 degrees to the oriented direction, and can be heat shrunk in the range of three to twenty percent in the oriented direction by exposure of about ten seconds to a temperature of about 225° F.; said length of film being fastened around said closure and outlet portion with said oriented direction extending circumferentially around said closure and outlet portion.

2. A seal according to claim 1 wherein said film is polypropylene.

3. A film adapted for use to form a seal about a closure and an outlet portion of a container closed by the closure, which seal must be at least partially peeled away to afford access to the closure and opening of the container, wherein said film is a uniaxially oriented polypropylene film having a thickness in the range of about 0.0025 to 0.009 centimeter, which film will easily tear in a straight line in the oriented direction, will break when stretched to less than 50 percent of its original dimension in the oriented direction and will break when stretched to less than about 10 percent of its original dimensions in a direction disposed at 90 degrees to the oriented direction, and can be heat shrunk in the range of three to twenty percent in the oriented direction by exposure of about ten seconds to a temperature of about 108° C., a length of said film being adapted to be fastened around said closure and outlet portion to form the seal with said oriented direction extending circumferentially around said closure and outlet portion.

4. A method for forming a heat shrinkable polyolefin film useful for forming a seal of the type comprising a length of polymeric film heat shrunk about a closure and an outlet portion of a container closed by the closure, which seal must be at least partially peeled away to afford access to the closure and opening of the container, said method comprising the steps of:

uniaxially orienting polyolefin at a temperature in the range of about 120° to 170° C. by stretching the film without restraining its edges at a draw ratio in the range of about 3/1 to 10/1 to form a film having a thickness in the range of about 0.0025 to 0.009 centimeter;

quickly cooling the oriented film to prevent substantial heat annealing and provide a heat shrinkable film.

5. A method for forming a seal about a closure and an outlet portion of a container closed by the closure, which seal must be at least partially peeled away to afford access to the closure and opening of the container, said method comprising the steps of:

uniaxially orienting polyolefin at a temperature in the range of about 120° to 170° C. by stretching the film without restraining its edges at a draw ratio in the range of about 3/1 to 10/1 to form a film having a thickness in the range of about 0.0025 to 0.009 centimeter;

quickly cooling the oriented film to prevent substantial heat annealing and provide a heat shrinkable film;

fastening a strip of the oriented film about the closure and the outlet portion of the container with the oriented direction of the strip extending circumferentially around the closure and outlet portion;

exposing the fastened strip of film to heat to shrink the strip about the closure and outlet portion of the container.

6. A method according to claim 6 wherein said exposing step exposes the film to a temperature of about 108° C. for about ten seconds.

* * * * *